United States Patent [19]

DeLuca

[11] 4,341,351

[45] Jul. 27, 1982

[54] OUTWARDLY OPENING POPPET PINTLE NOZZLE

[75] Inventor: Frank DeLuca, Enfield, Conn.

[73] Assignee: Stanadyne, Inc., Windsor, Conn.

[21] Appl. No.: 155,433

[22] Filed: Jun. 2, 1980

[51] Int. Cl.[3] ..... F02M 61/06

[52] U.S. Cl. ..... 239/453; 239/533.12

[58] Field of Search ..... 239/452, 453, 456, 533.7, 239/533.12

[56] References Cited

U.S. PATENT DOCUMENTS 2,815,247 12/1957 Hogeman ..... 239/453

FOREIGN PATENT DOCUMENTS 530196 12/1940 United Kingdom ..... 239/453

*Primary Examiner*—Andres Kashnikow

*Attorney, Agent, or Firm*—Prutzman, Kalb, Chilton & Alix

[57] ABSTRACT

A fuel injection nozzle of the outwardly opening poppet pintle type for use with internal combustion engines is provided which is economical to fabricate, assemble and recondition and which, at the same time, is capable of improved delivery and dispersion of fuel for optimum engine functioning even when the engine is intended to be operated at high speeds. The nozzle utilizes a nozzle holder which includes a separable holder body and holder body tip, both formed with an axial fuel passageway therethrough, and having aligned enlarged counterbores forming a chamber in which the upper end of a pintle valve is suspended by attachment to a slidable cup-shaped combination upper spring seat and valve hanger. The lower spring seat is also cup-shaped and is seated in the counterbore of the holder body tip to align the enlarged counterbores. The pintle valve stem, which is of smaller diameter than the fuel passageway of the body tip so as to provide an annular clearance throughout, has an enlarged collar and the lower spring seat has an eccentric aperture which cooperates with the passageway in the top to prevent the pintle valve from falling out of the tip if the stem breaks. The stem extends through the fuel passageway to the outer end of the tip where a conical valve seat is provided for engagement by an enlarged convex head on the end of the pintle valve stem.

11 Claims, 7 Drawing Figures

OUTWARDLY OPENING POPPET PINTLE NOZZLE

This invention relates to fuel injection nozzles for internal combustion engines and particularly to such nozzles of the outwardly opening poppet pintle type which are particularly adapted for use with high speed engines. The invention is more particularly concerned with an improved nozzle assembly therefor having many advantages in manufacture and use.

An outwardly opening poppet pintle type fuel injection nozzle is one which has an outwardly opening closure member called the pintle or valve which, when the nozzle is mounted on an engine, is movable toward the combustion chamber of the engine for admitting fuel to the said chamber. An example of a fuel injection nozzle of the type to which the present invention pertains is disclosed in U.S. Pat. No. 2,351,965. As will be noted, the valve of the nozzle assembly is opened by fuel pressure in the direction of the fuel flow through the valve to admit fuel to the engine combustion chamber which occurs each time a charge of fuel is transmitted to the nozzle by a conventional fuel pump. Most prior art nozzles of this type will have an adequate valve lift response for use on diesel engines operated at low engine speeds, but when such a nozzle is used on high speed diesel engines, the valve lift response is frequently inadequate to provide programmed fuel delivery rates and meet engine combustion requirements. Another disadvantage of such prior art nozzles is that they are usually composed of components which are difficult and expensive to fabricate or recondition and the nozzles are difficult to assemble and to adjust for proper operation.

The present invention is intended to overcome these disadvantages by providing a nozzle having a minimal reciprocating mass so that it can be operated effectively at high engine speeds. Another advantage of the invention is that the nozzle is made up of component parts which can be easily machined and finished using conventional manufacturing techniques to provide a free valve action and positive valving without need for extensive lapping, and the nozzle is simple to assemble and disassemble without requiring adjustment after assembly whereby manufacturing costs are reduced to a minimum. Another advantage of the invention is that the nozzle is designed with a variable clearance orifice for the passage and dispersion of the fuel providing optimum operating characteristics.

Other advantages will be in part obvious and in part pointed out in more detail in the following description and the accompanying drawing which sets forth an illustrative embodiment of the invention.

DESCRIPTION OF THE PREFERRED EMBODIMENT

Figure 1:
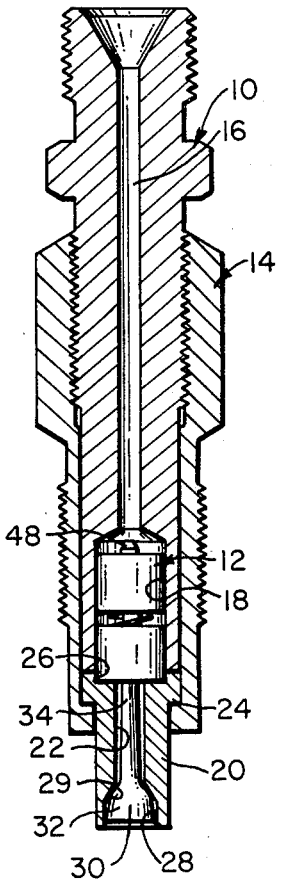
FIG. 1 is a longitudinal view, partially in cross-section, of a nozzle embodying the present invention.
Figure 2:
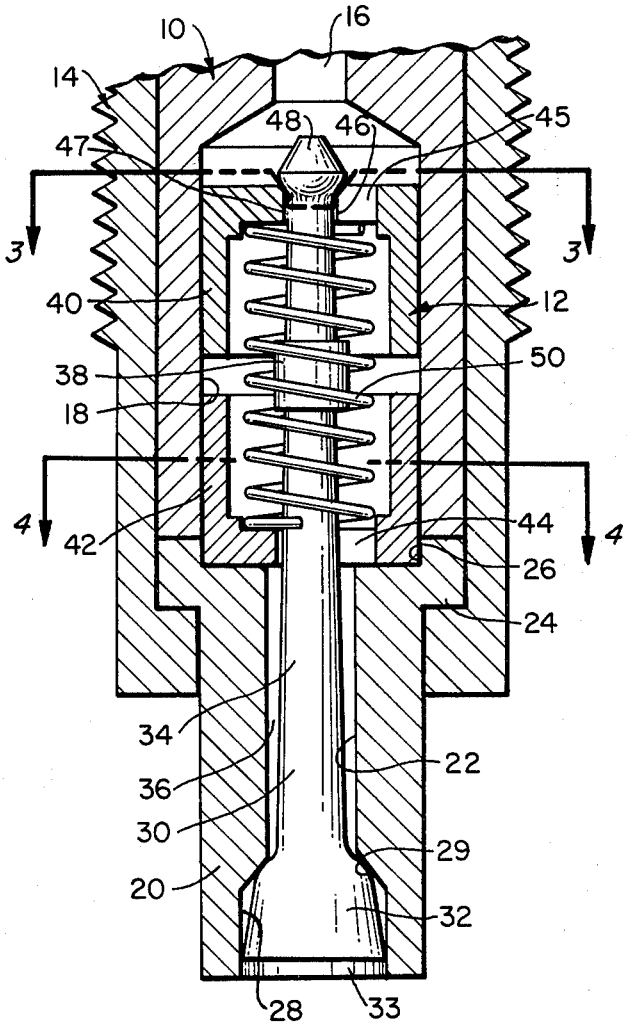
FIG. 2 is an enlarged, fragmentary longitudinal view, partially in cross-section of the lower end of the nozzle.
Figure 3:
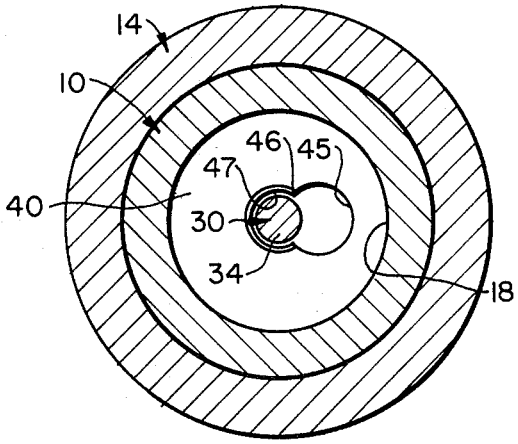
FIG. 3 is a cross-sectional view taken generally along the line 3—3 of FIG. 2.
Figure 4:
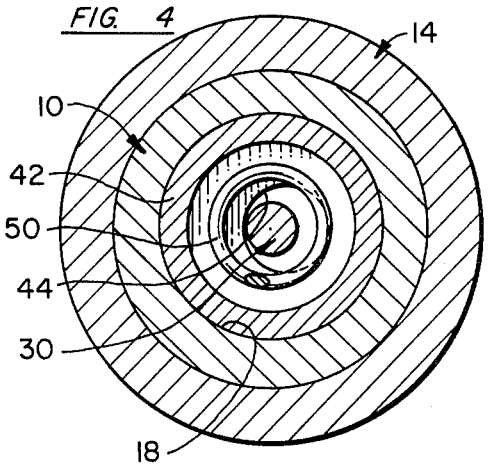
FIG. 4 is a cross-sectional view taken generally along the line 4—4 of FIG. 2.

Referring to the drawing showing a preferred embodiment of the invention, the nozzle comprises a holder body 10 and a removable nozzle assembly 12 retained therein by a tubular securing nut 14 threadably secured to the exterior of the body 10. As will be appreciated, the nozzle is adapted to be secured to an engine (not shown) by attachment to the securing nut 14.

The holder body 10 has a central fuel duct 16 and an enlarged counterbore 18 at its lower end. The upper end of the holder body 10 is adapted to be connected by a suitable conduit (not shown) to a fuel pump (also not shown) whereby fuel is supplied to the fuel duct 16.

Aligned with the holder body 10 is a body tip 20 having a central bore 22 and an enlarged peripheral shoulder 24 at its upper end. Shoulder 24 has the same outer dimensions as the adjacent portion of the holder body 10. A shallow counterbore 26 of the body tip 20 has the same diameter as and is coaxially aligned with the enlarged counterbore 18 of the holder body 10. The lower end of the body tip 20 is also counterbored at 28 to form a valve seat 29 for the pintle valve 30.

The pintle valve 30 has a head 32 at its lower end. The head 32 is rounded at its upper surface to seat on the conical valve seat 29 for fuel cut off. The lower end 33 of head 32 is enlarged to have a controlled clearance fit in counterbore 28. The stem 34 of valve 30 is dimensioned so as to provide an annular clearance 36 between it and the central bore 22. The pintle valve 30 is mounted in the holder body 10 by a cup-shaped combination upper spring seat and valve hanger 40 and an oppositely facing cup-shaped lower spring seat 42. The outer diameters of the upper spring seat and valve hanger 40 and lower spring seat 42 are the same and are dimensioned to provide a close fit with the inner diameters of counterbore 18 of the holder body 10 and upper counterbore 26 of the body tip 20 whereby the lower spring seat 42 functions to accurately align the counterbores 18 and 26 and whereby the upper spring seat and valve hanger 40 is also accurately aligned with counterbore 28 and valve seat 29.

The pintle valve 30 extends through an eccentrically located hole 44 in the end wall of lower spring seat 42 and a keyhole slot 46 in the end wall of the upper spring seat and valve hanger 40. The stem 34 of pintle valve 30 has an enlarged bulbous tip 48 at its upper end dimensioned so that it can pass through the eccentric hole 44 and the large portion 45 of the keyhole slot 46 but will engage and seat on the beveled smaller portion 47. The pintle valve 30 also extends through the center of a spiral compression return spring 50 seated between the upper spring seat and valve hanger 40 and the lower spring seat 42. The collar 38 which is located on the stem 34 of the pintle valve 30 between the upper spring seat and valve hanger 40 and lower spring seat 42 is intended to prevent the pintle valve 30 from falling into the engine in the event of breakage or separation from the upper spring seat and valve hanger 40. The collar 38 is dimensioned so that it just fits through the central bore 22 of the body tip 20 and the eccentric hole 44 in the lower spring seat 42.

The improved operation of the nozzle will be apparent from the foregoing description taken together with the following explanation. When the nozzle is in use on an engine, fuel enters the duct 16 and flows from there through the keyhole slot 46 and eccentric hole 44 to the annular clearance between the valve stem 34 and bore 22 of the body tip 20. When the fuel injection pressure increases to the preset nozzle opening pressure, the valve 30 opens outwardly compressing the spring 50 and fuel flows past the seat 29 and outwardly around the head 52. The valve 30 is guided at the upper end by the upper spring seat and valve hanger 40 which moves downwardly with the valve 30. The lower end of the valve 30 is guided in the counterbore 28 only when the valve is in seated position. During fuel injection the lower end of the valve 30 is centered hydrodynamically by the fuel flowing through the annular clearance between the valve stem 34 and bore 22 of the body tip 20. The extent of outward movement of the valve 30 is controlled by the engagement of the upper spring seat and valve hanger 40 against the lower spring seat 42.

A particular advantage of the nozzle construction of my invention as previously mentioned, is that by proper dimensional control, the valve is always aligned properly in the holder body 10, upper spring seat and valve hanger 40, lower spring seat 42 and body tip 20 and when open, is engaged only by the upper spring seat and valve hanger 40. This renders it possible to design the head 32 and counterbore 28 for optimum fuel dispersion characteristics. This arrangement also greatly reduces the size and cost of the nozzle. In addition, the nozzle is simple to assemble without need for adjustment. To assemble the nozzle, the valve 30 is first placed in the bore 22 of the body tip 20 following which the lower spring seat 42 is slipped over the valve to seated position in the counterbore 26. It will be noted that collar 38 may pass through hole 44 for assembly but, due to the eccentric relation of collar 38 to central bore 22, it cannot pass into central bore 22 after lower spring seat 42 is seated in counterbore 26. The spring 50 is then placed over the valve stem 34 and depressed as the upper spring seat and valve hanger 40 is installed. This nozzle assembly 12 is then inserted into the counterbore 18 of the holder body 10 which coaxially aligns upper spring seat and valve hanger 40 with lower spring seat 42. Holder body 10 is then clamped into place by the securing nut 14 which engages under the shoulder 24 of the body tip 20. It is to be noted that during assembly no bending or distortion of the valve 30 takes place. By reversing the procedure, the nozzle is just as simple to disassemble for inspection and for repair, reconditioning or replacement of any of the parts.

Figure 5:
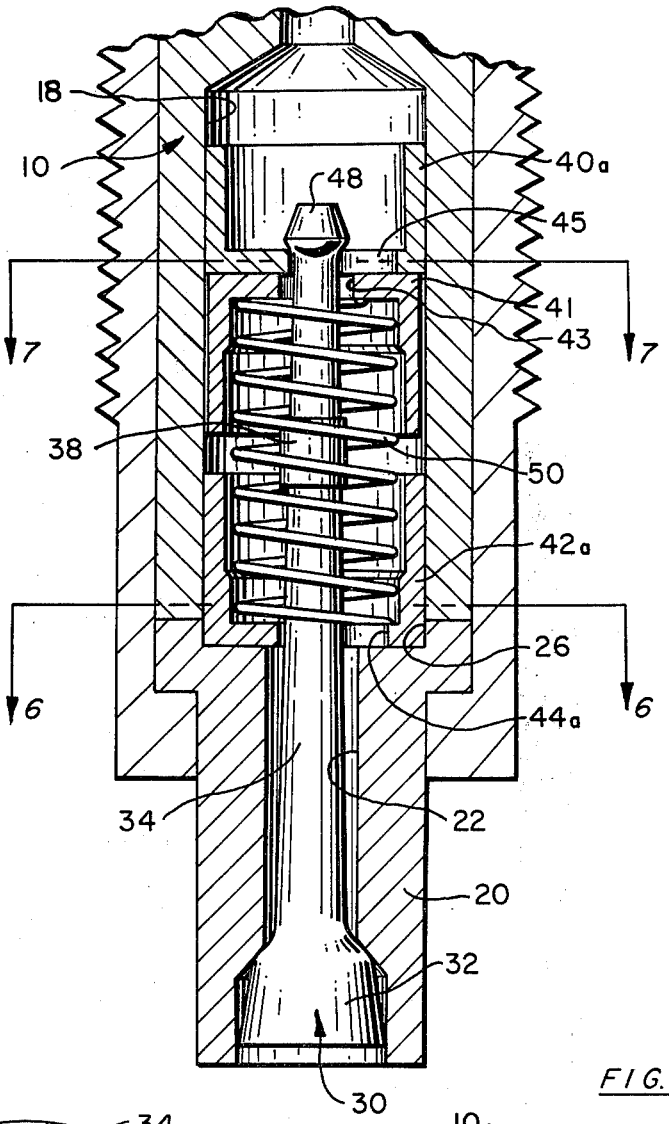
FIG. 5 is a longitudinal view similar to FIG. 2 showing another embodiment of the invention.
Figure 7:
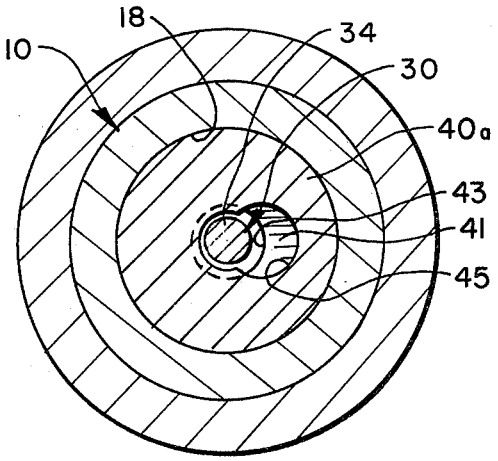
FIG. 7 is a cross-sectional view taken generally along the line 7—7 of FIG. 5.
Figure 6:
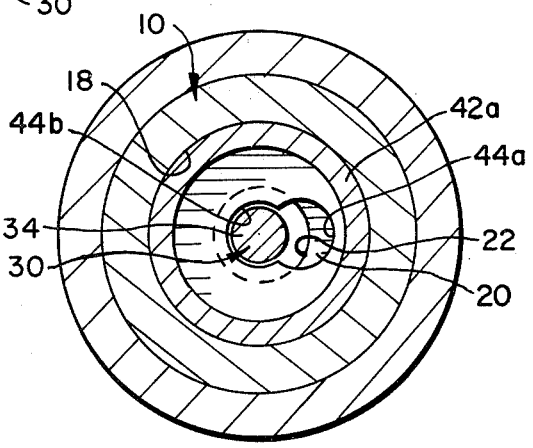
FIG. 6 is a cross-sectional view taken generally along the line 6—6 of FIG. 5.

A modified embodiment of the invention is shown in FIGS. 5–7. In this embodiment, the lower spring seat **42*a* is provided with a keyhole slot instead of the through hole 44 of the embodiment of FIGS. 1–4 which is disposed eccentrically with respect to bore 22 of body tip 20. The enlarged portion 44*a* of the keyhole slot has a sufficient diameter to pass the collar 38 during assembly before the lower spring seat 42*a* is moved laterally to assume its seated position in the counterbore 26. When so seated, the smaller portion 44*b* of the keyhole slot is concentric with the bore 22 and is of sufficient size to pass the stem 34 of the valve 30 but not the collar 38. In the event that the stem 34 should break above the collar 38, the collar 38 cannot pass through the smaller portion 44*b* of the keyhole slot and the larger portion 44*a* of the keyhole slot will provide unrestricted passage for the flow of fuel past the spring seat. If the collar should move laterally into the enlarged portion 44*a* of the keyhole slot, the smaller portion 44*b* will provide for unrestricted flow past the lower spring seat. Thus, pressure in the nozzle during subsequent injection cycles cannot build up high pressures to propel the broken portion of the valve 30** into the cylinder.

In the embodiment of FIGS. 5–7, the upper valve hanger design is also modified by forming the valve hanger and the upper spring seat 41 in two parts. The keyhole slot 45 through which the enlarged tip 48 passes during assembly is formed in the valve hanger and functions in the same manner as in the embodiment of FIGS. 1–4 with the upper end of the valve being guided by the valve hanger **40*a*. The upper spring seat 41 is an inverted cup-shaped member which is preferably slightly spaced from the annular wall of the enlarged counterbore 18 of the holder body and has a concentric hole 43 which is coaxial with the smaller portion of the keyhole slot 45 so that in the event that the tip 48 of the valve should become disengaged from the hanger during operation, it cannot move laterally a sufficient distance to pass through the larger portion of the keyhole slot 45 since the hole 43 of the spring seat acts as a lateral stop. Preferably the distance between the upper end of the skirt of the valve hanger 40*a* and the end of the enlarged counterbore 18 of the holder body 10 is limited so that the spring 50 can expand sufficiently to maintain valve hanger 40*a* and upper spring seat 41, as well as lower spring seat 42*a* and nozzle body 20, from separating even though the stem 34 of the valve 30 breaks so that the valve 34** cannot fall out of the nozzle.

As will be apparent, the parts are simple to fabricate and can be machined and surface finished to produce free valve action and positive valving without extensive lapping or subsequent adjustment.

As will be apparent to one skilled in the art, various modifications, adaptations and variations of the foregoing specific disclosure may be made without departing from the teachings of the present invention.

I claim:

1. In a fuel injection nozzle, a nozzle holder body having a throughbore forming a fuel passageway provided with an upper inlet end and having an enlarged counterbore at its lower end forming a valve mounting chamber, a holder body tip detachably connected to the nozzle holder body having a throughbore and a counterbore at its upper end of the same diameter and registering with the counterbore of the nozzle holder body, valve mounting means comprising oppositely facing cup members having a spiral spring therebetween, one cup member being slidably mounted in the counterbore of the nozzle holder body and forming a combination upper spring seat and valve hanger, and the other cup member being seated in the counterbore of the holder body tip forming a lower spring seat and partially extending into the counterbore of the nozzle holder body to coaxially align the counterbores, a pintle valve having a stem disposed in the throughbore of the holder body tip and extending through openings in the oppositely facing cup members, said stem having an enlarged tip at its upper end engaging on the upper spring seat and valve hanger, a valve seat formed at the lower end of the throughbore of the holder body tip, and a head on the lower end of the pintle valve stem for engaging the valve seat.

2. A fuel injection nozzle as defined in claim 1 wherein the lower cup member has an eccentrically located hole and the upper cup member has a keyhole slot through which the stem of the pintle valve extends.

3. A fuel injection nozzle as defined in claim 1 wherein the enlarged tip at the upper end of the pintle valve is dimensioned so that it can be passed through the eccentrically located hole and the large portion of the keyhole slot but will engage against the periphery of the smaller portion of the keyhole slot to depend the pintle valve from the upper spring seat and valve hanger.

4. A fuel injection nozzle as defined in claim 1 wherein the holder body tip has a shoulder portion engaging against the nozzle holder body and is releasably attached thereto by a securing nut threadably mounted on the nozzle holder body and engaging underneath the shoulder portion of the holder body tip.

5. A fuel injection nozzle as defined in claim 1 wherein the lower cup member has an eccentrically located hole through which the stem of the pintle valve extends, and the stem has a collar thereon dimensioned so that it can be passed through the hole when coaxial therewith but will engage the periphery of the hole when axially aligned with the lower cup member thereby restraining the pintle valve from accidentally falling out of the nozzle as a result of breakage or part failure.

6. A fuel injection nozzle as defined in claim 1 wherein the upper and lower spring seats are normally spaced apart by the spiral spring therebetween and are adapted to engage when the pintle valve opens to limit opening movement of the pintle valve.

7. In a fuel injection nozzle, a nozzle holder body having a throughbore forming a fuel passageway provided with an inlet and having an enlarged counterbore at its lower end, a holder body tip provided with a throughbore forming a fluid passageway and having an enlarged counterbore at its upper end, said counterbores being coaxially aligned and forming a valve mounting chamber, means releasably attaching the holder body tip to the nozzle holder body, a spring biased valve hanger slidably mounted in the counterbore of the nozzle holder body, a pintle valve depending axially from the valve hanger having a stem disposed in the throughbore of the holder body tip, and a lower spring seat in the counterbore of the holder body tip, said lower spring seat spanning the juncture between the counterbores.

8. A fuel injection nozzle as defined in claim 7 wherein said lower spring seat has a bottom wall mounted in said counterbore of said holder body tip, said bottom wall having a key hole slot therethrough the smaller portion of which is disposed substantially concentric with said throughbore.

9. A fuel injection nozzle as defined in claims 7 or 8 including an upper spring seat mounted in said counterbore of said nozzle holder body, said upper spring seat being separate from said valve hanger and having an upper wall engageable therewith, said valve hanger having a keyhole slot therethrough and said upper wall having a hole therethrough disposed substantially concentric with the small portion of the keyhole slot in said valve hanger.

10. A fuel injection nozzle as designated in claim 7 wherein the stem is of smaller diameter than the throughbore of the holder body tip, the lower spring seat has an eccentrically located hole through which the stem of the pintle valve extends, and the stem has a collar thereon dimensioned so that it can be passed through the eccentrically located hole when coaxial with the hole but will engage the periphery of the hole when the lower spring seat is mounted in the counterbore of the holder body tip thereby restraining the pintle valve from accidentally falling out of the nozzle as a result of breakage or part failure.

11. A fuel injection nozzle as designed in claim 7 wherein the stem is of smaller diameter than the throughbore of the holder body tip, the lower spring seat has a key hole slot therein through which the stem of the pintle valve extends, and the stem has a collar thereon dimensioned so that it can be passed through the key hole when the collar is coaxial with the larger portion of the key hole slot but will engage the periphery of the smaller portion of the key hole slot when the lower spring seat is mounted in the counterbore of the holder body tip thereby restraining the pintle valve from accidentally falling out of the nozzle as a result of breakage or part failure.

* * * * *